United States Patent [19]

Carlone

[11] 3,948,037

[45] Apr. 6, 1976

[54] WRIST POSITION-ACTUATABLE SWITCH

[76] Inventor: Eugene R. Carlone, 150 W. 82 St., New York, N.Y. 10024

[22] Filed: Jan. 22, 1975

[21] Appl. No.: 543,148

[52] U.S. Cl. ..... 58/50 R
[51] Int. Cl.[2] ..... G04B 19/30
[58] Field of Search ..... 58/23 BA, 50 R

[56] References Cited

UNITED STATES PATENTS

| | | | |
|---|---|---|---|
| 3,823,550 | 7/1974 | Bergey | 58/50 R |
| 3,841,080 | 10/1974 | O'Donald | 58/23 BA |
| 3,855,784 | 12/1974 | Foellner | 58/50 R |

*Primary Examiner*—George H. Miller, Jr.

[57] ABSTRACT

A solid state watch includes two gravity switches, one closable when the arm is positioned such that the wrist extends substantially horizontally and the other simultaneously actuatable when the arm and/or wrist is twisted or rotated sidwardly while the wrist is maintained in its horizontal position, such that both switches one in sequence circuit with the other are subject to being concurrently thereby closed at a same period in time, during which the completed closed circuit of the circuitry to a solid state read-out assembly is activated thereby making possible the observing and reading of the time by the person reading the watch without any requirement of use of the other hand, the particular readout being dependent upon the duration of period of closing of the switch closing upon the twisting of the wrist and/or upon a predetermined number of sequential to and fro twists of the wrist.

11 Claims, 5 Drawing Figures

WRIST POSITION-ACTUATABLE SWITCH

This invention relates to a novel switch for a wristwatch switching mechanism.

BACKGROUND OF THE INVENTION

Prior to the present invention, there have existed various types of watches including for example, those provided with lights having pressure-actuatable switches mounted within the watch band thereof, and more recently solid state watches having one or more actuation buttons for actuating read-out(s). In both types of these prior-noted watches, use of the hand of the free other arm from which the watch is mounted, was required for an actuation of the electrical system necessary for a person to observe the time. For example, in use of a watch of the type disclosed in U.S. Pat. No. 3,729,923, the dial cannot be observed at night without first applying pressure to the switch-actuating pivoted element thereof by use of an opposite arm's hand or by pressing the wrist against some object while concurrently trying to see the dial. In like manner, the wrist band switch of U.S. Pat. No. 3,681,587 is similarly actuatable of the circuitry thereof by exerting pressure onto the wrist band itself in order to close the electrical contacts thereof. Each of solid state watches of the U.S. Pat. Nos. 3,789,601 and 3,760,584, as well as the electronic timepiece of U.S. Pat. Nos. 3,603,073, include one or more actuation members which must be actuated by the hand of the free other arm from which the wristwatch is mounted.

Accordingly, for a person driving an automobile, or carrying packages in one or both arms, or otherwise having one of the two arms occupied by other functions, it is not only inconvenient for the person to position his watch in a manner such that it is viewable and readable, but additionally, difficulty is causes in sopositioning the arm by virtue of the need to push the actuating button making possible a reading of the correct time by the person. Even more important, for the driver of an automobile or other vehicle, there is the hazard of losing control of the steering or other control of the vehicle, if and when a person has to divert both hands and his eyes all substantially simiultaneously in order to make possible the determining of the time of day.

SUMMARY OF THE INVENTION

Accordingly, objects of the present invention include the obtaining of solutions to and/or avoidance of one or more problems and/or difficulties of the types discussed above, together with the obtaining of other novel advantages.

Another object, more particuarly, is to provide a novel wristwatch actuatable at the will of the wearer without the necessity of use of an opposite hand or of pressing the watch against some adjacent object.

Another object is to obtain a wristwatch switch actuation mechanism actuatable by movement of the wrist carrying the watch.

Another object is to obtain a solid state watch having read-out actuatable by movement of the wrist in predetermined directions to predetermined positions.

Another object is to obtain a solid state watch having one or more read-out circuits commonly actuatable by a same gravity switch mechanism but separately actuatable in time and sequence of the different read-out circuits.

Another object is to prevent accidental closing of read-out gravity-switches by virtue of relative positioning thereof in relation to watch position on the wrist when mounted as worn by a person.

Other objects become apparent from the preceding and following disclosure.

One or more objects of the present invention are obtained by the invention as defined herein.

Broadly the invention may be defined as a wristwatch having the casing wristwatch support structure mountable on the wrist typically in a conventional manner as any known or desired wristwatch, utilizing a time-keeping mechanism of any conventional or known or desired type, together with an electrical circuitry for facilitating the observing and reading of time by a person whenever the circuitry is actuated to thereby close an electrical circuitry switch as a result of at least one and preferably two gravity switches in series circuit, one activatable to close circuit as the wrist is brought to the horizontal position for the longitudiaxis thereof, and the other to be actuated when the wrist is twisted in rotation a predetermined number of degrees, there being preferably a series of contacts for separate activation thereof by the second gravity switches lever arm as dependent upon how far the wrist is rotatably twisted to move by gravity the switch arm first to one contact, then past that contact to a second, and the like. Also, for any one or more contacts, sustained duration of contact therewith by the lever arm can cause a subsequent electrical element in that activated circuit or subcircuit to become activated after a predetermined period of circuit activation, and/or for another element to become deactivated, by the employment of conventional switch elements and electrical and/or electronic components well known in the art, or as desired. In a preferred embodiment of the invention, the wristwatch works and mechanism thereof are solid state of a conventional or any desired type, such as for example those disclosed in various U.S. patents such as U.S. Pat. Nos. 3,760,584 to Dargent, and 3,789,601 to Bergey, the disclosures of each of which are hereby incorporated by reference in their entirety as a part of this disclosure. As in conventional typical watches, preferably the solid state watch embodiments of this invention include connected as a part of the actuating circuitry and display circuitry, sequence-actuating switching elements actuatable of different subcircuits responsive to different actuating impulses, such as impulses of a sequence of two or more consecutive actuations within a predetermined time period, and/or such as the maintaining of an actuating signal continually for a predetermined period.

A part of the objects are obained by having a first gravity switch responsive to gravity only in and along one plane along the vertical, such that raising the arm to a horizontal wrist position closes that circuit when the wrist is raised to a position in which the upper face of the wrist is facing upward. A second gravity switch is preferably responsive to motion of a twisting of the wrist solely in a twist direction in one direction, namely when the wrist twists the upper surface of the wrist to a sidewardly position a predetermined number of degrees, this gravity switch also being responsive to gravity in movement in and along one predetermined plane, this plane being transverse to the longitudinal axis of the wrist. Thus, in this preferred embodiment, the read-out mechanism is actuated solely when the wrist is horizontal and concurrently the wrist is twist-revolved toward the person.

The invention may be better understood by making reference to the following Figures.

THE FIGURES

FIG. 1 illustrates a side perspective view of a typical wristwatch of the present invention as if mounted on a persons wrist with the forearm raised and with the wrist in the laterally inwardly twisted or revolved position such that the dial diodes are illustrating or displaying the month and date of the month.

FIG. 2 illustrates a side perspective view of two gravity switches typical of the present invention, illustrated in proper positions relative to the position of the wristwatch shown in phantom, with the switches in states typical of their positions when the wrist watch is in the position mounted on the wrist as indicated at the position of watch illustration 36*a* of FIG. 4 described below, with the forearm horizontal but wrist not twisted.

Figure 1:
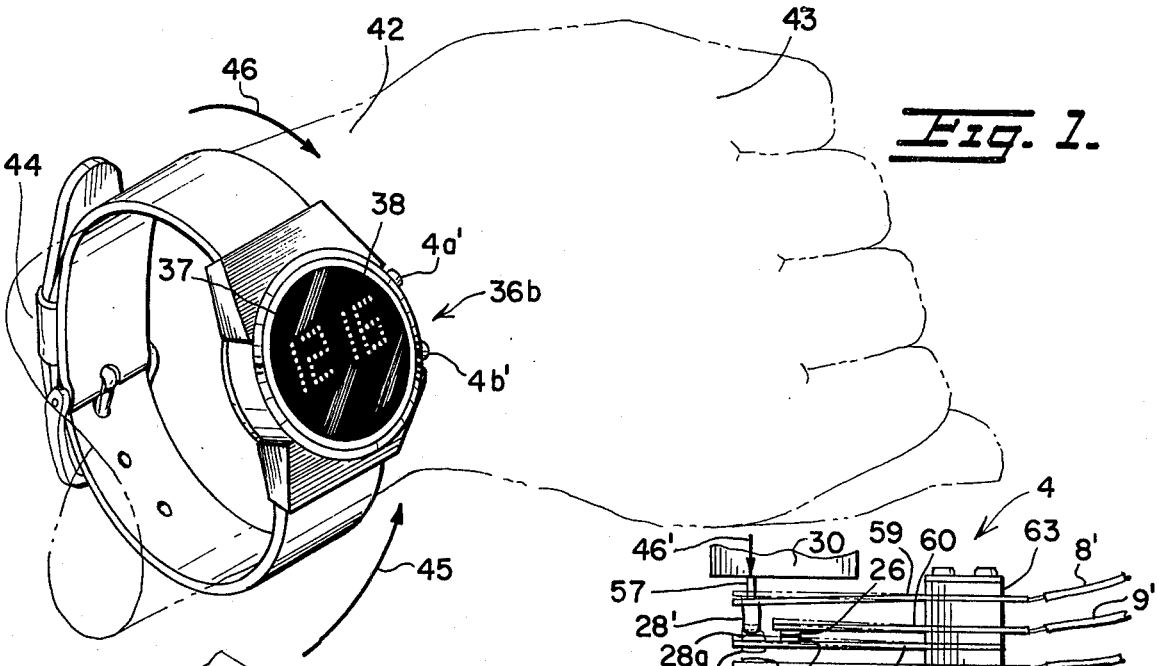
Figure 3:
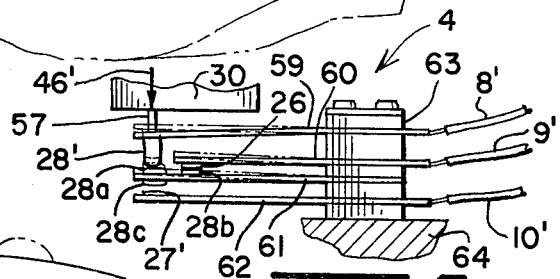
FIG. 3 illustrates an elevation side view in an in-part view of the double switch of FIG. 2, illustrating in greater detail and greater clarity the switch activatable by the twist of the wrist, to thereby close the wrist when the watch is laterally revolved to the FIG. 1 position illustrated, in a closed state.
Figure 2:
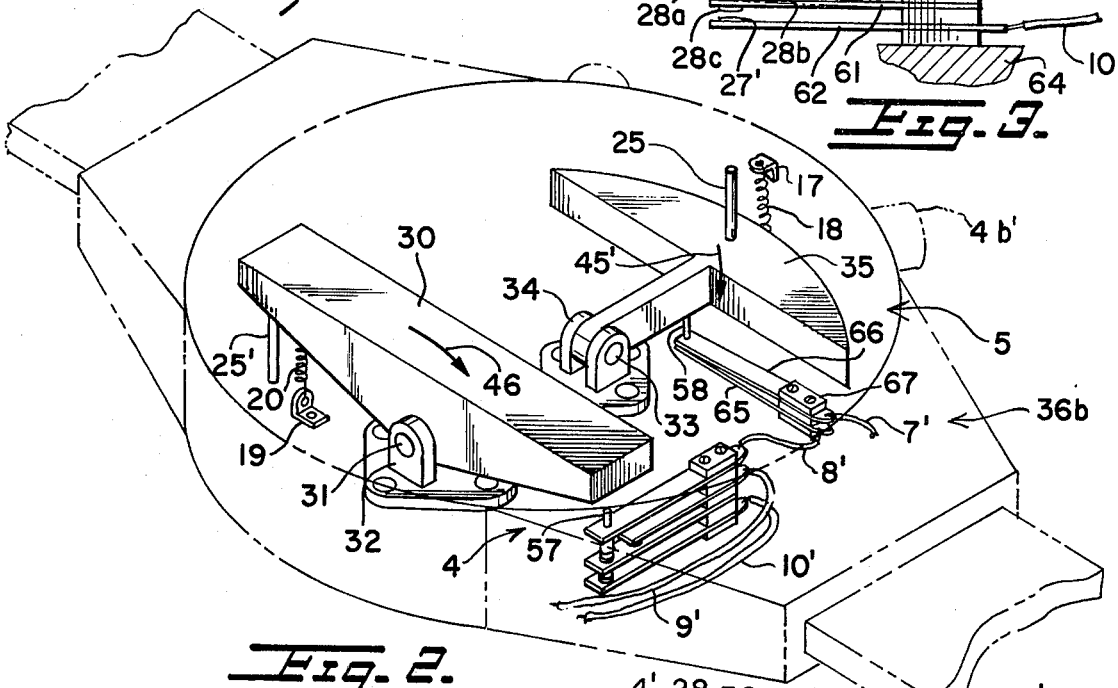
Figure 4:
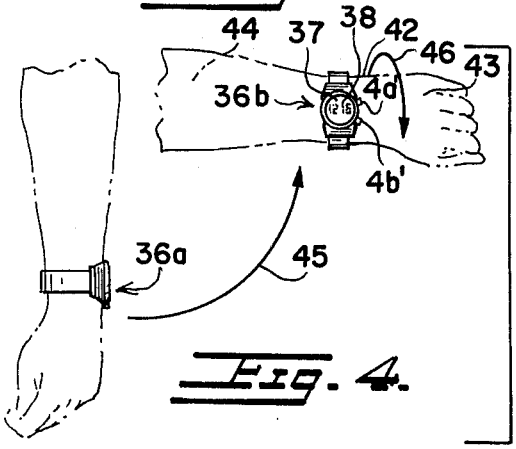
FIG. 4 illustrates in side elevation view the watch of FIG. 1 as it would appear on a persons arm shown in phantom after the downard-hanging forearm position has been raised, and twisted to a twisted wrist position corresponding to the position of FIG. 1.
Figure 5:
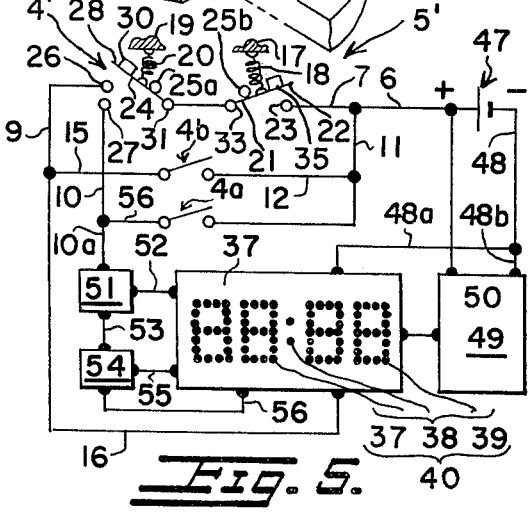

FIG. 5 illustrates diagrammatically a novel gravity switch arrangement and circuitry thereof for the present invention as would be embodied in the wristwatch of FIGS. 1, 2, and 4 of which the switches of FIGS. 2 and 3 are a part, in watch 36*a* state.

DETAILED DESCRIPTION

FIG. 1 illustrates a novel gravity switches wristwatch having the required circuitry of the present invention, typically as viewed in elevation side view thereof. The FIG. 5 illustrates a complete diagrammatic circuitry of a solid state watch typical of the present invention. The preceding FIGS. 1 through 5 illustrate preferred embodiments of the present invention. FIG. 3 gravity switch 4 is shown in a closed state position after a lateral twisting of the wrist in the direction of arrow direction 46 as illustrated in each of FIGS. 1, 2, and 4; prior to the twisting of the wrist, but after the watch has been positioned when the forearm is raised to the horizontal position, the state of the closed horizontal switch 5 and of the open-circuit switch 4 are as illustrated in FIG. 2. The FIG. 5 illustrated circuitry in the open-circuit positions for all switches is representative of the circuitry and switches when the forearm is downwardly hanging. It should be noted at this point that the switch 5 does not readily (if at all) become closed ever unless when the wrist or forearm are twisted the forearm has previously been raised to a substantially horizontal position of FIGS. 1 and 2 and 4 for the watch 36*b* position, as opposed to the FIG. 4 watch 36*a* position; also, when the arm and/or forearm are in a substantially horizontally extending position, the switch 5 becomes closed solely in response to an inward twisting or revolving of the wrist, not to an outward twist of the arm, forearm and/or wrist, such that the possibility of accidental closing of the switch 5 concurrently or simultaneously with the closing of the switch 4 is substantially if not totally eliminated, this avoiding major expenditures of electrical energy that would be otherwise lost whenever the diodes of the watch dial became activated by continual accidental activations. It is noted that the springs 20 and 18 respectively are each optional but preferred, but if utilized, each spring must be sufficiently weak (of predetermined strength and biasing action) as to not accidentally disengage electrical contact(s) of closed switches 4 and/or 5, such springs having the advantage of making accidental inertia possibly accidentally close the switch(es). Also, such springs more surely make certain the prompt and factual return of the switches 4 and 5 respectively to their open states when arm positions are such as to no longer properly bring about closing of the switch(es).

In the diagrammatic FIG. 5 illustration, the lever arm 21 with its mass 35 when moved to a closed position engages contact 22 with contact 23 of the electrical circuit as the forearm is raised to the horizontal position of the watch positions 36*b* of FIGS. 1, 2, and 4, as compared to an open state of switch 4 or 4′ when the arm and forearm are downwardly hanging, for example such that in the downwardly hanging forearm position the mass 35 is merely downwardly hanging from and by the pivot pin 33 on the base mounting structure 34. In greater detail of the FIG. 5 diagrammatic circuitry, lead wire 6 continues as lead wire 7 to contact 23 of the diagram whereby gravity pull on mass 35 causes contact 22 to close circuit with contact 23 when the forearm is raised to a horizontally extending position. When switch 4 or 4′ is in a closed state, contact 22 continues as lead wire 8 to contact 28. Contact 28 first will close circuit with contact 26 upon a twisting of the wrist only slightly, and upon a further twisting of the wrist as weighted by mass 30, continues to cause the switch to further close to thereby break circuit with the contact 26 and to establish contact with 27. With reference to the more definite structure of gravity switches illustrated in FIGS. 2 and 3, the theory of circuitry is followed, but the actual switch contacts and arrangement of masses is somewhat different as follows. Accordingly, the corresponding switches of FIGS. 2 and 3 are switches 4 and 5, as compared to switches 4′ and 5′ of FIG. 5. In FIG. 2, it may been seen that lead 7′ corresponds to the FIG. 5 lead 7, and similarly the FIG. 3 lead 8′ and FIG. 2 lead 8′ corresponds to the FIG. 5 lead 8. In FIG. 2, the lead 7′ connects with contact strip 66 mounted by structure 67 to close contact circuit with contact strip 65 whenever plunger 58 presses downwardly on an upper surface of contact strip 66, and circuit thereupon continues through contact strip to lead 8′ on to contact strip 59 of FIG. 3, contact strip 59 including an extension contact 28′ which when pressed slightly into a closed position against contact 28*a* normally biased upwardly pressing its contact 28*b* against contact strip 60 contact 26 thereof, and thereupon further continues to lead wire 9′. Further downward pressure of mass 30 serves to cause extension contact 28′ to flex downwardly the strip contact 61 such that circuit becomes broken (opened) between contacts 28*a* and 26 while concurrently and simultaneously engagement to close circuit is made between contacts 28*c* and 27′ of contact strip 62 which continues circuit with lead wire 10′. With further continued reference to FIG. 5 circuitry thereafter circuitry from contact 26 leads by leads 9 and 16 directly to a desired diode subcircuitry such as military time — as for example 1600 hour, whereas circuitry from contact 27 leads to a selector switch 51 by leads 10 and 10*a*, which conventional selector switch 51 upon one initial activation thereof continues circuitry through lead wire 53, but upon predetermined timed-interval two consecutive sequential activations (closings) of contacts 28 and 27 serve to send circuitry signal current through lead wire 52 to a subcircuit of the diodes such as to read-out the month and date thereof; electrical signal through lead 53 typically initiates electrical circuit through conventional selector switch 54 which upon initial activation passes current through lead wire 55 to a diode subcircuit which typically causes a read-out of the time in conventional AM or PM hour and minutes, but which upon continued maintaining of actuation beyond a predetermined time period switches circuitry electrical signal to lead wire 56 to initiate activation of a consecutive second readout which will continue so long as circuitry is maintained closed. The diode circuits or subcircuits are diagrammatically represented by separate numerals 37, 38, and 39, as collectively diode circuits and diodes 40 for example, on dial face 37, with power lead 50 to power the time-keeping mechanism of conventional type of a solid state, from typical and diagrammatically represented solid state works 49 powered by power lead 57, with return leads 48*a* and 48*b* continuing as lead 48 to the power source 47. From lead wire 6, lead wire 11 branches to lead power lead wires 12 and 13 to by-pass switches 4*b* and 4*a* respectively which when closed continue circuitry through lead wires 15 and 56 respectively to lead wires 16 and 10*a* respectively.

Accordingly, it may be seen that in the month readout position illustrated for wristwatch 36*b* position of FIG. 1 and FIG. 4 repectively, the horizontal positioning of the forearm has caused the mass 35 to bear down by gravitational pull by plunger 58 against strip contact 58 to close strip contact circuitry against the strip contact 65, and the illustrated twisted position has caused as in FIG. 3 the closing of the circuitry comparable to the activation of leads 9 and 16 of the FIG. 5 diagrammatic circuitry. Thus, with the watch 36*b* mounted by its watchband on the forearm 44 at the wrist 42 adjacent the hand 43, the degree of revolving inward twist of the forearm and/or wrist determines whether merely circuit lead wire 9' becomes activated with signal or whether the next activation occurs instantaneously by a further twisting of the forearm and/or wrist to a greater angle such that the gravitational pull causes the mass 30 to close circuitry to bring about signal flow through lead wires 10 and 10*a*, as the mass 30 pivots on its pivot pin 31 mounted on support 32. The stop 25' prevents excessive backward pivoting, and corresponds to the FIG. 5 stop 25*a*, whereas the stop 25 corresponds to the FIG. 5 stop 25*b*. It should be noted that when the forearm is moved in direction 45, the mass 35 moves in an opposite direction 45'. When the forearm and/or wrist is rotatably twisted inwardly, in direction 46, similarly the mass 30 becomes pivoted in direction 46, to close circuitry.

It is within the scope of the invention to make obvious modifications and substitution of equivalents.

I claim:

1. A wristwatch switch device comprising in combination: a wristwatch support structure, wristwatch means for keeping time mounted on the wristwatch support structure, an electrical time-display circuit means for facilitating the observing and reading of time-indicating indicia when the electrical time-display circuit means is actuated, the electrical time-display circuit means including a switch means for closing and breaking electrical circuit, the switch means including elements operatively connected to function as a gravity switch positioned on the support structure for closing circuit solely when said wristwatch support means is positioned in a predetermined upright plane such that predetermined mass of the gravity switch responsive to gravity is closable of electrical circuit responsive to movement of the support structure in solely one predetermined direction of movement along said predetermined upright plane to a closed-circuit positioned adapted such that movements in other planes and in other directions do not close circuit of the electrical time-display circuit means, said switch means further including elements for returning to an open-circuit state when the support structure is not in each of said predetermined plane and said closed-circuit position.

2. A wristwatch switch device of claim 1, in which said support structure includes forward and rearward edges and wristwatch mounting structure thereof being positoined such that said forward and rearward edges are located at consecutive points along an imaginary axis extending substantially parallel to a longitudinal axis of a person's wrist when the support structure is mounted on a person's wrist, and said switch means being mounted on said support structure such that said upright plane is substantially transverse to said imaginary axis.

3. A wristwatch switch device comprising in combination: a wristwatch support structure, wristwatch means for keeping time mounted on the wristwatch support structure, an electrical time-display circuit means for facilitating the observing and reading of time-indicating indicia when the electrical time-display circuit means is actuated, the electrical time-display circuit means including a switch means for closing and for breaking electrical circuit, the switch means including elements operatively connected to function as a gravity switch positioned on the support structure for closing circuit solely when said wristwatch support means is positioned in a predetermined upright plane such that predetermined mass of the gravity switch responsive to gravity is closable of electrical circuit responsive to movement of the support structure in solely one predetermined direction of movement along said predetermined upright plane to a closed-circuit position adapted such that movements in other planes and in other directions do not close circuit of the electrical time-display circuit means, said switch means further including elements for returning to an open-circuit state when the support structure is not in each of said predetermined plane and said closed-circuit position, said switch means including a switch lever arm pivotally mounted on said support structure for pivotal movement in said predetermined plane and having predetermined mass mounted thereon in a position such that when said switch lever arm is aligned for movement in and along said predetermined plane, said predetermined mass causes said switch lever arm to move to said closed-circuit position when said support structure is moved in said predetermined direction, said electrical time-display circuit means including a plurality of consecutive alternate switch contacts alternately closable at different predetermined positions along a path of movement of the switch lever arm, the respective ones of said plurality each being connected to a different subcircuit of the electrical time-display circuit means.

4. A wristwatch switch device in claim 3 in which said electrical time-display circuit means includes sequence actuation switching elements actuatable of different subcircuits of the electrical time-display circuit means, the sequence-actuation switching elements being actuated responsive to different predetermined numbers of sequential actuations of the switch lever arm.

5. A wristwatch switch device of claim 3 including mounted on said support structure in electrical series with said gravity switch a horizontal gravity switch means for closing circuit solely when said support structure is substantially horizontally positioned along an axis extending substantially parallel to said imaginary axis.

6. A wristwatch switch device comprising in combination: a wristwatch support structure, wristwatch means for keeping time mounted on the wrist watch support structure, and electrical time-display circuit means for facilitating the observing and reading of time-indicating indicia when the electrical time-display circuit means is actuated, the electrical time-display circuit means including a switch means including elements operatively connected to function as a gravity switch positioned on the support structue for closing circuit solely when said wristwatch support means is positioned in a predetermined upright plane adapted such that predetermined mass of the gravity switch responsive to gravity is closable of electrical circuit responsive to movement of the support structure in solely one predetermined direction of movement along said predetermined upright plane in a closed-circuit position adapted such that movements in other planes and in other directions do not close circuit of the electrical time-display circuit means, said switch means further including elements for returning to an open-circuit state when the support structure is not in each of said predetermined plane and said closed-circuit position, said wristwatch means being an operative solid state wristwatch works operatively connected with the electrical time-display circuit means, the electrical time-display circuit means including electro-optical digital light-emitting diodes connected to be actuated upon the closing of circuit of the switch means upon the presence of actuating pressure of the predetermined mass when the support structure is in each of said predetermined plane and said closed-circuit position, said switch means including a switch lever arm pivotably mounted on said support structure for pivotal movement in said predetermined plane and having said predetermined mass mounted thereon in a position such that when said switch lever arm is aligned for movement in and along said predetermined plane, said predetermined mass causes said switch lever arm to move to said closed-circuit position when said support structure is moved in said predetermined direction, said support structure including forward and rearward edges and wristwatch mounting structure thereof being positioned such that said forward and rearward edges are located at consecutive points along an imaginary axis extending substantially parallel to a longitudinal axis of a person's wrist when the support structure is mounted on a persons's wrist, and said switch means being mounted on said support structure adapted such that said upright plane is substantially transverse to said imaginary axis, and in which said switch means is positioned to effect switch-closing of circuit when the support structure is tilted laterally in said predetermined direction, and a horizontal gravity switch means for closing circuit solely when said support structure is substantially horizontally positioned along an axis extending substantially parallel to said imaginary axis, said horizontal gravity switch means being mounted on said support structure in electrical series with said gravity switch.

7. A wristwatch switch device comprising in combination: a wristwatch support structure, wristwatch means for keeping time mounted on the wristwatch support structure, an electrical time-display circuit means for facilitating the observing and reading of time-indicating indicia when the electrical time-display circuit means is actuated, the electrical time-display circuit means including a switch means for closing and for breaking electrical circuit, the switch means including elements operatively connected to function as a gravity switch positioned on the support structure for closing circuit solely when said wristwatch support means is positioned in a predetermined upright plane adapted such that predetermined mass of the gravity switch responsive to gravity is closable of electrical circuit responsive to movement of the support structure in solely one predetermined direction of movement along said predetermined upright plane to a closed-circuit position adapted such that movements in other planes and in other directions do not close circuit of the electrical time-display circuit means, said switch means further including elements for returning to an open-circuit state when the support structure is not in each of said predetermined plane and said closed-circuit position, said switch means including a switch lever pivotably mounted on said support structure for pivotal movement in said predetermined plane and having said predetermined mass mounted thereon in a position such that when said switch lever arm is aligned for movement in and along said predetermined plane, said predetermined mass causes said switch lever arm to move to said closed-circuit position when said support structure is moved in said predetermined direction.

8. A wristwatch switch device of claim 7, in which said support structure includes forward and rearward edges and wristwatch mounting structure thereof being positioned such that said forward and rearward edges are located at consecutive points along an imaginary axis extending substantially parallel to a longitudinal axis of a person's wrist when the support structure is mounted on a person's wrist, and said switch means being mounted on said support structure such that said upright plane is substantially transverse to said imaginary axis, and in which said switch means is positioned to effect switch-closing of circuit when the support structure is tilted laterally in said predetermined direction.

9. A wristwatch switch device of claim 7, in which said wristwatch means is an operative solid state wristwatch works operatively connected with the electrical time-display circuit means, the electrical time-display circuit means including electro-optical digital light-emitting diodes connected to be actuated upon the closing of circuit of the switch means upon the presence of actuating pressure of the predetermined mass when the support structures is in each of said predetermined plane and said closed-circuit position.

10. A wristwatch switch device of claim 9, in which said switch means includes a switch lever arm pivotably mounted on said support structure for pivotal movement in said predetermined plane and having said predetermined mass mounted thereon in a position such that when said switch lever arm is aligned for movement in and along said predetermined plane, said predetermined mass causes said switch lever arm to move to said closed-circuit position when said support structure is moved in said predetermined direction.

11. A wristwatch switch device comprising in combination: a wristwatch support structure, wristwatch means for keeping time mounted on the wristwatch support structure, an electrical time-display circuit means for facilitating the observing and reading of time-indicating indicia when the electrical time-display circuit means is actuated, the electrical time-display circuit means including a switch means for closing and for breaking electrical circuit, the switch means including elements operatively connected to function as a gravity switch positioned on the support structure for closing circuit solely when said wristwatch support means is positioned in a predetermined upright plane adapted such that predetermined mass of the gravity switch responsive to gravity is closable of electrical circuit responsive to movement of the support structure in solely one predetermined direction of movement along said predetermined upright plane to a closed-circuit position adapted such that movements in other planes and in other directions do not close circuit of the electrical time-display circuit means, said switch means further including elements for returning to an open-circuit state when the support structure is not in each of said predetermined plane and said closed-circuit positon, said electrical time-display circuit means including sequence actuation switching elements actuatable of different subcircuits of the electrical time-display circuit means, the sequence-actuation switching elements being actuated responsive to different predetermined numbers of sequential actuations of the switch lever arm.

* * * * *